US006099047A

United States Patent [19]

Reiff et al.

[11] Patent Number: 6,099,047

[45] Date of Patent: Aug. 8, 2000

[54] LOCK MECHANISM

[76] Inventors: Douglas L. Reiff, 2850 E. Prestwick, Warsaw, Ind. 46580; Ross A. Weldy, 2505 Waterbend Dr., Elkhart, Ind. 46514

[21] Appl. No.: 09/267,533

[22] Filed: Mar. 12, 1999

[51] Int. Cl.[7] ..... E05C 5/02

[52] U.S. Cl. ..... 292/4; 292/87; 292/107; 292/62; 292/129; 292/31; 292/DIG. 37; 206/1.5

[58] Field of Search ..... 292/25, DIG. 37, 292/80, 83, 87, 101, 107, 95, 58, 62, 4, 8, DIG. 61, 110, 114, 129, 31; 42/70.11; 403/348, 325; 206/317, 807, 1.05, 404, 405, 54

[56] References Cited

U.S. PATENT DOCUMENTS

| | | | |
|---|---|---|---|
| 337,412 | 3/1886 | Long . | |
| 718,081 | 1/1903 | Brackett . | |
| 725,662 | 4/1903 | Bohlen . | |
| 1,183,464 | 5/1916 | Johnson . | |
| 1,947,282 | 2/1934 | Theis . | |
| 2,104,838 | 1/1938 | Leonard . | |
| 2,186,666 | 1/1940 | Cereda | 292/170 |
| 2,189,227 | 2/1940 | Schoch . | |
| 2,239,301 | 4/1941 | Papst . | |
| 2,296,606 | 9/1942 | Gaffney . | |
| 2,496,737 | 2/1950 | McCallick et al. . | |
| 2,729,418 | 1/1956 | Maynard | 248/361 |
| 3,307,755 | 3/1967 | Lentz . | |
| 3,454,153 | 7/1969 | Jensen | 206/405 |
| 4,208,837 | 6/1980 | Black, Sr. et al. | 49/56 |
| 4,557,476 | 12/1985 | Kato | 272/8 N |
| 4,655,489 | 1/1989 | Bisbing | 292/110 |
| 4,660,871 | 4/1987 | Arakawa et al. | 292/81 |
| 4,676,370 | 6/1987 | Rudick | 206/1.5 |
| 4,801,232 | 1/1989 | Hempel | 411/552 |
| 5,344,010 | 9/1994 | Dryer et al. | 206/317 |

*Primary Examiner*—B. Dayoan
*Assistant Examiner*—Clifford B Vaterlaus
*Attorney, Agent, or Firm*—Barnes & Thornburg

[57] ABSTRACT

A lock mechanism for cases or containers which includes engagable lock elements, one of which can be rotatable into a lockable and a non-lockable alignment. The exposed surfaces of the lock elements are flush with surrounding wall surfaces of the case or container when the mechanism is locked. The mechanism can be concealed by matching the exposed surfaces of the lock elements with the surrounding surfaces of the case or container. The mechanism include springs which bias the lock elements. Appropriate spring strengths can be selected to prevent infants and young children from opening the mechanism.

20 Claims, 5 Drawing Sheets

LOCK MECHANISM

TECHNICAL FIELD

The present invention relates generally to lock mechanisms. More particularly, the present invention is directed to lock mechanisms which are suitable for use in conjunction with containers and cases, and which can include concealed operating mechanisms and/or can provide child resistant operation.

BACKGROUND ART

There are numerous types of containers and cases which require locked security. For example, various shipping containers and storage containers may require a locking mechanism in order to protect theft or unauthorized access or use of their contents. Examples of such containers include containers in which medical, pharmaceutical, or laboratory items or materials are stored and/or shipped, and containers in which small, valuable items such as jewelry and gem stones are stored and/or shipped. Examples of cases which typically include locking mechanisms include brief cases, computer cases, travel cases and gun cases.

Typical locking mechanisms for shipping containers can include clips, pins, latches, sealing ties, sealing straps, etc. Typical locking mechanisms for cases include combination locks and spring latch mechanisms.

The present invention provides a lock mechanism for containers and cases which is secure and resistant to unauthorized access.

DISCLOSURE OF THE INVENTION

According to other features, characteristics, embodiments and alternatives of the present invention which will become apparent as the description thereof proceeds below, the present invention provides a lock mechanism having an axis which includes:

a first lock element which is movable along the axis and includes at least one lug;

a spring element which biases the first lock element in a first direction along the axis;

a second lock element which is rotatable and movable along the axis and includes at least one lug which is engagable with the at least one lug of the first lock element; and a spring element which biases the second lock element in a second direction along the axis which is opposite to the first direction.

The present invention further provides a lock mechanism having an axis and provided in a case having opposed walls which includes:

a first lock element provided in a first one of the opposed walls of the case which includes at least one lug and is movable along the axis;

a spring element which biases the first lock element towards the first wall;

a second lock element provided in a second one of the opposed walls of the case which includes at least one lug and is rotatable and movable along the axis; and a spring element which biases the second lock element towards the second direction wall.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to lock mechanisms which are suitable for use in conjunction with containers and cases, and which can include concealed operating mechanisms and/or can provide child resistant operation. The lock mechanism of the present invention includes lock elements which are selectively engagable with one another. The lock elements can be provided in opposing walls of a case or container so that when the case or container is closed, the lock elements become axially aligned. Each of the lock elements include one or more lugs. The lock elements can be engaged to one another by rotating one of the lock elements so that their lugs are aligned. Once the lugs of the lock elements are aligned, the lock elements can be pushed together to engage the lugs. The lock elements can be disengaged by rotating one of the lock elements so that their lugs are not aligned.

The lock mechanism of the present invention is designed to be concealed, if desired. In this regard, the lock elements have outer or exposed surfaces which are flush with the surrounding surfaces of a case or container in which the lock mechanism is installed. The lock mechanism of the present invention can be essentially concealed by matching the surface appearance, i.e., color, texture, design, etc. of the exposed surfaces of the lock elements with the surrounding surfaces of the case or container. The lock elements are biased by spring elements, and are accessed by pushing one of the lock elements against a spring force into the case or container so that the other lock element is pushed beyond the opposite surface of the case or container. The spring biasing force can be selected to prevent infants and young children from opening the lock mechanism.

Figure 1B:
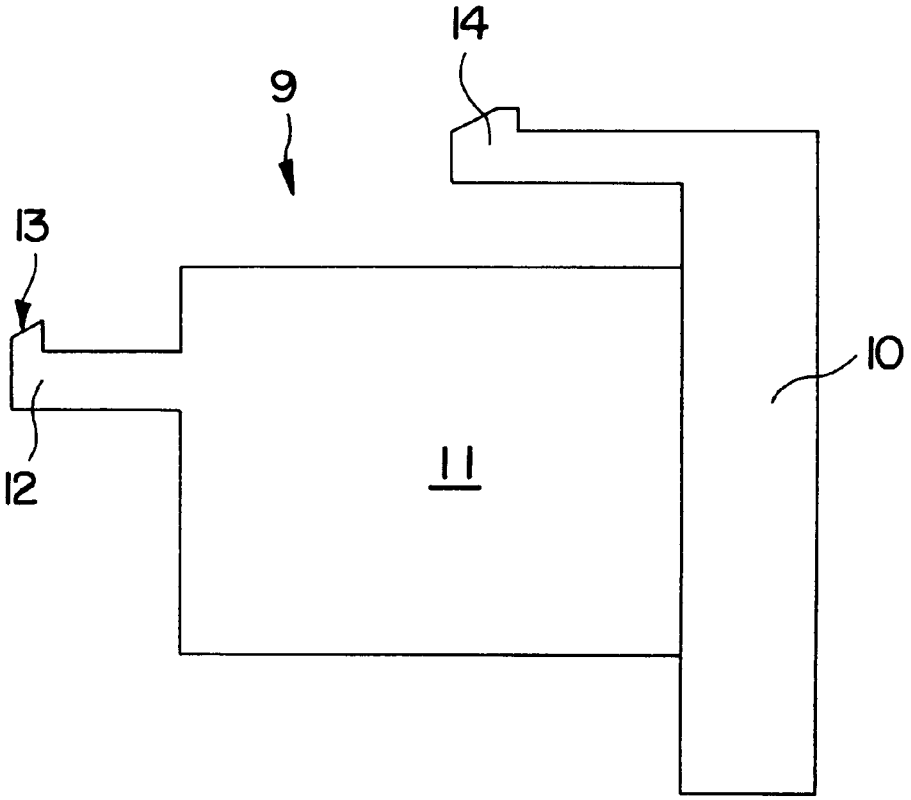
FIGS. 1*a* and 1*b* are cross-sectional views of respective fixed and rotatable elements of a lock mechanism according to one embodiment of the present invention.
Figure 1A:
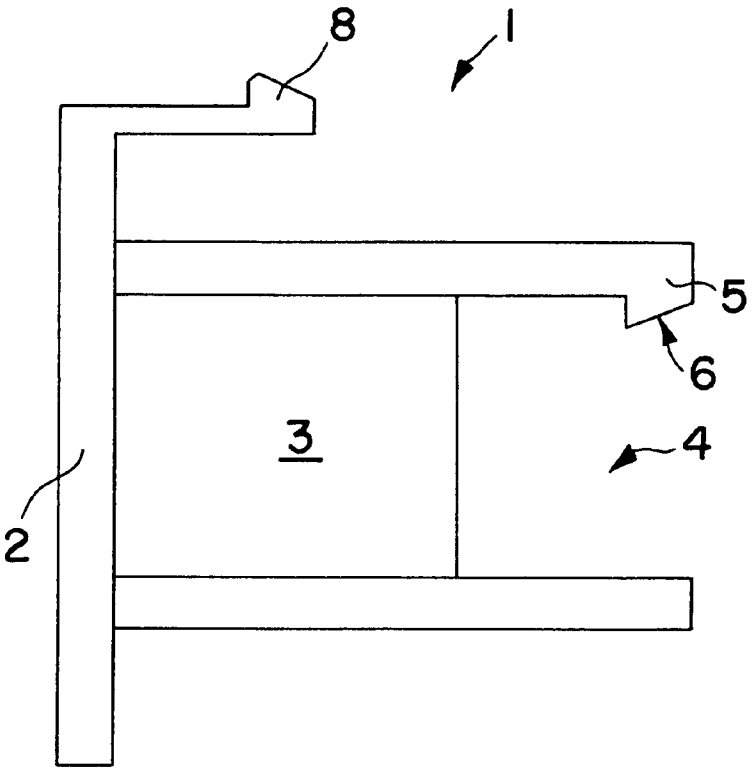

FIGS. 1*a* and 1*b* are cross-sectional views of respective fixed and rotatable elements of a lock mechanism according to one embodiment of the present invention. The term "fixed" as used herein refers to rotational movement. As described herein, each of the fixed and rotatable elements of the lock mechanism are axially movable. However, one of the elements should be "fixed" against rotational movement for purposes which will become apparent below.

FIG. 1*a* depicts the fixed lock element 1. This element includes a base 2 and a cylindrical body 3 which extends from the base 2. The cylindrical body 3 includes an open-centered end 4 having one or more discrete, inwardly directed overhanging lugs 5.

Although one lug 5 is depicted in FIG. 1*a*, the use of a plurality, e.g., three or more lugs 5, symmetrically spaced about the cylindrical body 3 is preferred. The lugs 5 can be defined as discrete finger-like projections which extend axially from the cylindrical body 3. In other embodiments, the lugs 5 can be defined by discrete lip structures which extend radially inward from the cylindrical body 3. As depicted, the lugs 5 include cam surfaces 6 which coact with corresponding cam surfaces on finger lugs that are provided on the rotatable lock element as discussed below.

Figure 3:
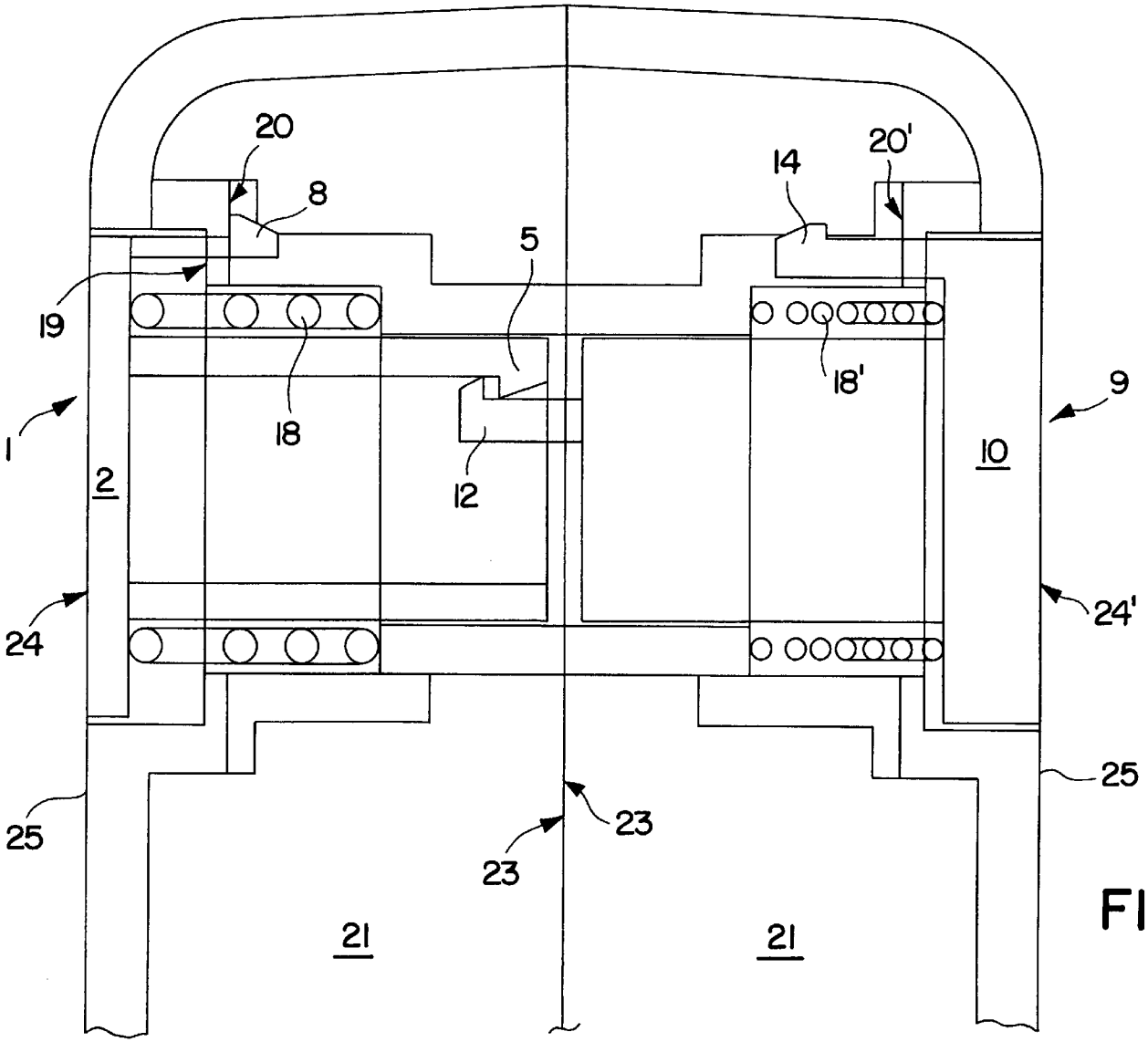
FIG. 3 is a cross-sectional view of a lock mechanism located in a case or container according to one embodiment of the present invention.

The fixed lock element 1 is received in one end of a cylindrical chamber 7 of the lock mechanism (see FIG. 3). The fixed lock element 1 is held in the cylindrical chamber 7 (against a spring biasing force) by one or more resilient lugs 8 which extend inwardly from an edge of base 2.

As will be understood from the description below, one of the fixed and rotatable lock elements are required to rotate in order to properly align the cooperating lug elements. Although for purposes of the present disclosure the element depicted in FIG. 1*a* is referred to as the fixed lock element, it is to be understood that, according to other embodiments, this lock element could be allowed to rotate and the lock element depicted in FIG. 1*b* could be fixed, i.e., non-rotatable.

The fixed lock element 1 can have a circular or non-circular base 2 as desired, as long as the cylindrical chamber 7 which receives the fixed lock element has a correspondingly shaped stepped end portion to receive the base 2 as described below.

FIG. 1*b* depicts the rotatable lock element 9. This element includes a base 10 and a cylindrical body 11 which extends from the base 10. The cylindrical body 11 includes one or more resilient finger lugs 12.

Although one finger lug 12 is depicted in FIG. 1*a*, the use of a plurality, e.g., three or more finger lugs 12 (corresponding to the number of discrete lugs 5 provided on the fixed lock element), symmetrically spaced about the cylindrical body 11 is preferred. As depicted, the finger lugs 12 include cam surfaces 13 which coact with corresponding cam 6 surfaces on lugs 5 that are provided on the fixed lock element 1 discussed herein. The finger lugs 12 should be sufficiently resilient so that when the fixed and rotatable lock elements 1, and 9 are pushed together, the cam surfaces 6 and 13 of the lugs 5 and finger lugs 12 contact one another and cause the finger lugs 12 to deflect inwardly and thereafter engage the lugs 8 so as to couple the fixed and rotatable lock elements 1 and 9 together. In this regard, the finger lugs 12 can be made from a resilient plastic material. Whereas the lugs 5 of the fixed lock element 1 can be made of a rigid plastic material or a metal.

The rotatable lock element 9 is received in an opposite end of a cylindrical chamber 7 of the lock mechanism (see FIG. 3). The rotatable element 9 is held in the cylindrical chamber 7 (against a spring biasing force) by one or more resilient lugs 14 which extend inwardly from an edge of base 10. As discussed below, the resilient lugs 14 that extend from the base 10 of the rotatable lock element 9 are long enough to allow the rotatable lock element 9 to be held in the cylindrical chamber 7, while allowing the base 10 to extend beyond the cylindrical chamber 7 for grasping the base 10 and manually rotating the rotatable lock element 9.

The rotatable lock element 9 can have a circular or non-circular base 10 as desired, as long as the cylindrical chamber 7 which receives the rotatable lock element 9 has a correspondingly shaped stepped end portion to receive the base 10 as described below.

Figure 2:
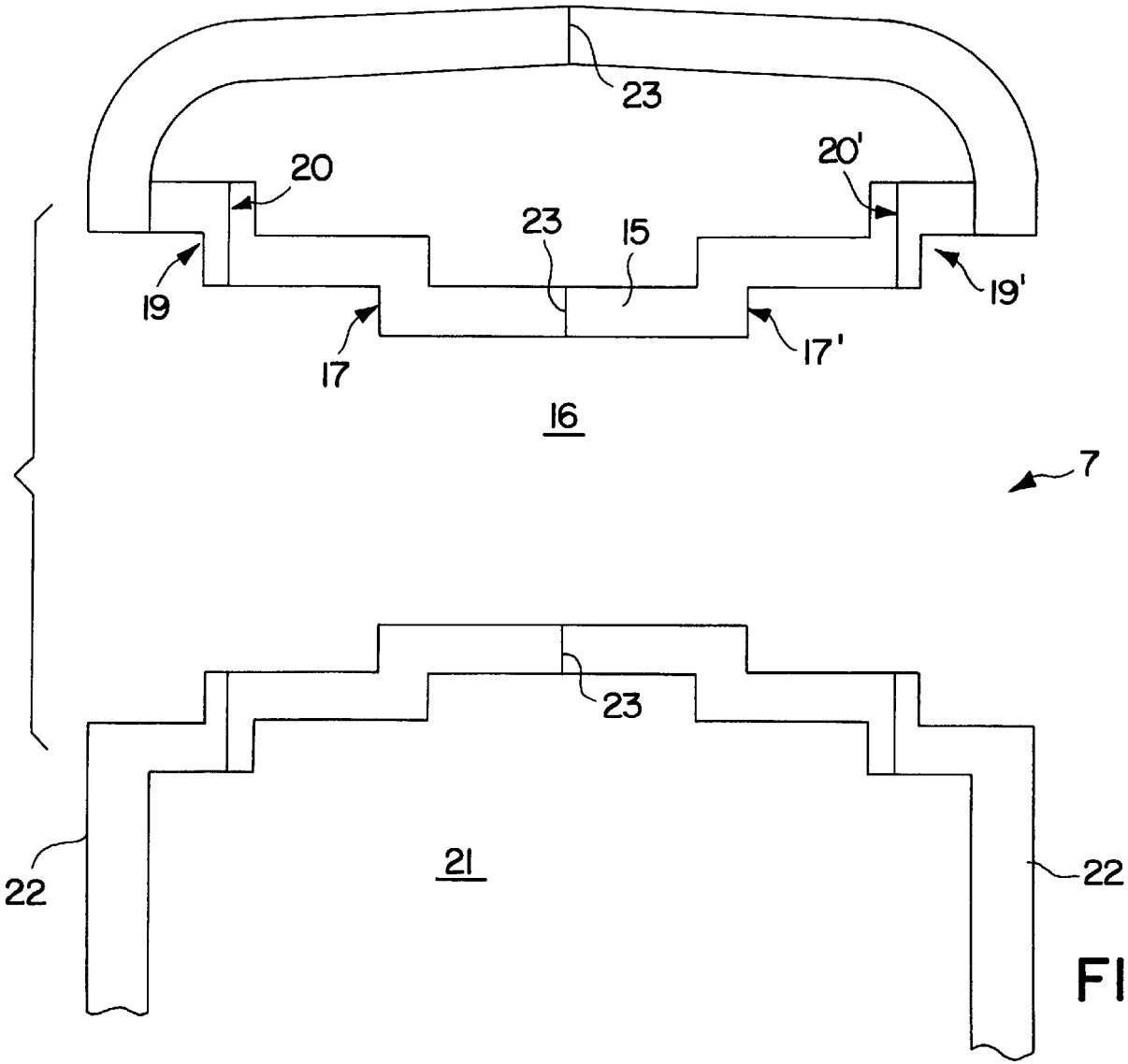
FIG. 2 is a cross-sectional view of a cylindrical lock chamber located in a case or container according to one embodiment of the present invention.

FIG. 2 is a cross-sectional view of a cylindrical lock chamber located in a case or container according to one embodiment of the present invention. The cylindrical chamber 7 is defined by a stepped housing 15 which has a central portion 16 that is complementarily shaped to receive the bodies 3, 11 of the fixed and rotatable lock elements 1 and 9. The cylindrical chamber 7 includes inner-most stepped portions 17, 17' which receive biasing spring elements 18, 18' (see FIG. 3) as discussed below. The cylindrical chamber 7 also includes outer-most stepped portions 19, 19' which are complementarily shaped to receive the bases 2, 10 of the fixed and rotatable lock elements 1 and 9. The cylindrical chamber 7 also includes cut-out stepped portions 20, 20' which the resilient lugs 8, 14 can engage to hold the fixed and rotatable lock elements 1, 9 in the cylindrical chamber 7. It is noted that the number of the cut-out stepped portions 20, 20' should be equal in number to the corresponding resilient lugs 8 and 14, and that the cut-out stepped portions 20, 20' and corresponding resilient lugs 8, 14 be symmetrically spaced apart from one another.

In FIG. 2 the cylindrical chamber 7 is depicted as being located near one end or edge of the case or container 21 and as extending through the walls 22 thereof. It is to be understood that the cylindrical chamber 7 and associated lock mechanism could be located anywhere between opposing walls of a case or container. It is also noted that the cylindrical chamber 7 comprises two half chamber portions which contact at surfaces 23 when the case or container containing the lock mechanism is closed.

FIG. 3 is a cross-sectional view of a lock mechanism located in a case or container according to one embodiment of the present invention. FIG. 3 depicts the lock mechanism in a locked position with the outer surfaces 24, 24' of bases 2, 10 of the fixed and rotatable lock elements 1, 9 flush with the outer surfaces 25 of the case or container 21. From FIG. 3 it can be understood how the lock mechanism of the present invention can be essentially concealed by matching the surface appearance, i.e., color, texture, etc., of the outer surfaces 24, 24' of bases 2, 10 of the fixed and rotatable lock elements 1, 9 with the outer surfaces 25 of the case or container 21. Otherwise, or additionally, the shape of the outer surfaces 24, 24' of the bases 2, 10 of the fixed and rotatable lock elements 1, 9 can be concealed or camouflaged within a pattern or design that extends on the outer surfaces 23 of the case or container 21.

FIG. 3 depicts the resilient lugs 8 on the base 2 of the fixed lock element 1 as being engaged with the cut-out stepped portions 20. This engagement is maintained by a biasing force which is applied by spring element 18 which can comprise a circular spring which surrounds the cylindrical body 3 of the fixed lock element 1. When the resilient lugs 8 are engaged with the cut-out stepped portions 20, the outer surface 24 of the base 2 of the fixed lock element 1 is flush with the surrounding surface 25 of the case or container 21. As discussed below, the fixed lock element 1 can be pushed inwardly into the cylindrical chamber 7 until the base 2 contacts stepped portion 19 of the cylindrical chamber 7.

In the locked position depicted in FIG. 3 the resilient finger lugs 12 of the rotatable lock element 9 are engaged with the lugs 5 of the fixed lock element 1.

The rotatable lock element 9 is held in the cylindrical chamber by engagement between resilient lugs 14 and cut-out stepped portions 20'. As in the case of the fixed lock element 1, the rotatable lock element 9 can be pushed inwardly into the cylindrical chamber 7. In the locked position depicted in FIG. 3, the rotatable lock element 9 is held at an inward position by the biasing force of spring element 18 which is stronger than the biasing force of spring element 18'. In this locked position, the outer surface 24' of the base 10 of the rotatable lock element 9 is flush with the surrounding surface 25 of the case or container 21.

As can be understood for FIG. 3, in the unlocked position (not shown) the lugs 5 and finger lugs 12 are not engaged and the biasing force of spring element 18' causes the rotatable lock element 9 to be pulled outwardly from the cylindrical chamber 7 until the resilient lugs 14 engage the cut-out step portions 19'. In this unlocked position, the base 10 of the rotatable lock element 9 can be grasped by its peripheral edge and rotated to change the alignment between the lugs 5 of the fixed lock element 1 and the finger lugs 12 of the rotatable lock element 9.

FIG. 3 also depicts the two halves of the case or container 21 which contact at surfaces 23 which the two halves of the case or container are closed together.

Figure 4:
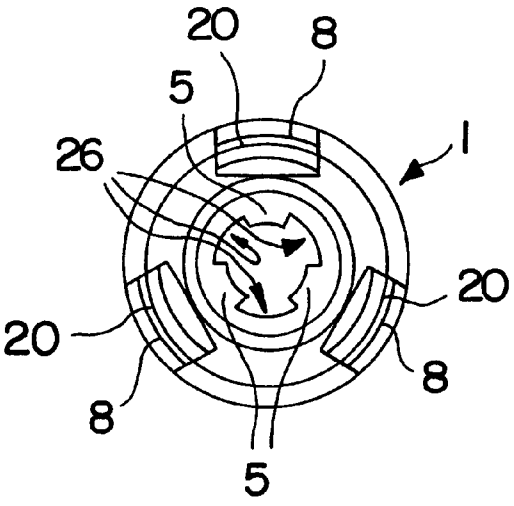
FIG. 4 is an end view of a fixed lock element and cylindrical chamber according to one embodiment of the present invention.

FIG. 4 is an end view of a fixed lock element and cylindrical chamber according to one embodiment of the present invention. The embodiment of the fixed lock element 1 depicted in FIG. 4 includes three discrete lugs 5 which are spaced symmetrically about cylindrical body 3. The spaces 26 between the lugs 5 enable the finger lugs 12 of the rotatable lock element 9 to pass therethrough when unlocking or disengaging the lock elements as discussed below.

The resilient lugs 8 of the fixed lock element 1 and the cut-out stepped portions 20 of the cylindrical chamber 7 are depicted in FIG. 4 as have coextensive arcuate dimensions. This coextensive relationship between the lugs 8 and cut-out stepped portions 20 ensure that the fixed lock element 1 cannot be rotated within cylindrical chamber 7.

Figure 5B:
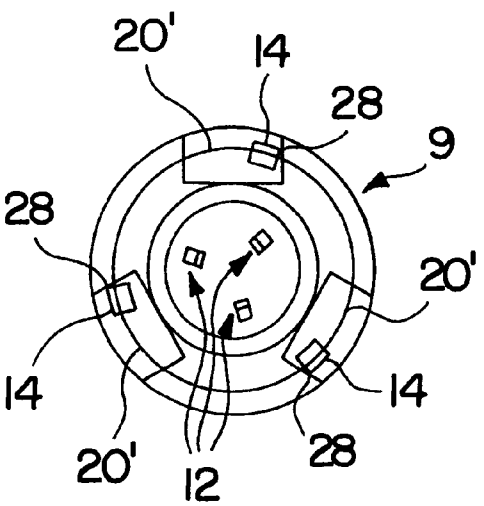
FIG. 5*b* is an end view of a fixed lock element and cylindrical chamber according to one embodiment of the present invention which is shown in an open or openable orientation.
Figure 5A:
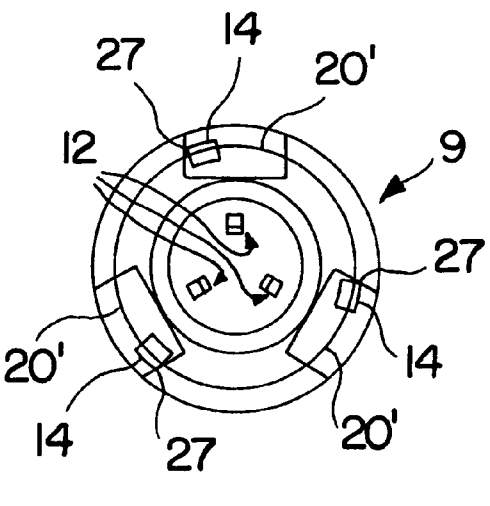
FIG. 5*a* is an end view of a fixed lock element and cylindrical chamber according to one embodiment of the present invention which is shown in a locked or lockable orientation.

FIG. 5*a* is an end view of a fixed lock element and cylindrical chamber according to one embodiment of the present invention which is shown in a locked or lockable orientation. The embodiment of the rotatable lock element 9 depicted in 5*a* includes three finger lugs 12 which are symmetrically arranged. The resilient lugs 14 are depicted as having a smaller width than the cut-out stepped portions 20' formed in the cylindrical chamber 7. This difference in dimensions allows the rotatable lock element 9 to rotate in either direction until the resilient lugs 14 abut the corresponding sides of the cut-out stepped portions 20'. In FIG. 5*a* the resilient lugs 14 are depicted as abutting sides 27 of the cut-out stepped portions 20'. In this position, the finger lugs 12 are aligned with the corresponding lugs 5 of the fixed lock element 1 depicted in FIG. 4. When the rotatable lock element 9 is rotated in the position depicted in FIG. 5*a*, and pushed inwardly into the cylindrical chamber 7, the cam surfaces 13 of the finger lugs 12 will contact the corresponding cam surfaces 6 of lugs 5 causing the finger lugs 12 to deflect radially inward and pass through and engage lugs 5 of the fixed lock element 1. The engagement of lugs 5 and finger lugs 12 will prevent the rotatable lock element 9 from being released from the fixed lock element 1, whose spring element 18 will maintain the fixed and rotatable lock elements 1, 9 in the locked position depicted in FIG. 3.

FIG. 5*b* is an end view of a fixed lock element and cylindrical chamber according to one embodiment of the present invention which is shown in an open or openable orientation. In FIG. 5*b*, the resilient lugs 14 are depicted as abutting sides 28 of the cut-out stepped portions 20'. In this position, the finger lugs 12 are aligned with the spaces 26 between the lugs 5 as depicted in FIG. 4. In this alignment, the finger lugs 12 can pass freely through the spaces 26 between lugs 5 and the rotatable lock element 9 will not become engaged with the fixed lock element 1.

In operation, a case or container having the lock mechanism of the present invention installed is closed so that the half portions of cylindrical chamber 7 abut. In the initial unlocked position, the rotatable lock element 9 is biased by spring element 18' so as to extend beyond the surrounding surface 25 of the case or container. In this position, the peripheral edge of the base 10 of the rotatable lock element 9 can be rotated so that the finger lugs 12 are aligned with the corresponding lugs 5 of the fixed lock element 1. Once aligned, the rotatable lock element 9 can be pushed into the cylindrical chamber 7 by pushing on the outer surface 24' of the base 10 thereof.

As the rotatable lock element 9 is pushed into cylindrical chamber 7 the cam surfaces 13 of the finger lugs 12 will contact the corresponding cam surfaces 6 of lugs 5 causing the finger lugs 12 to deflect radially inward to pass through and engage lugs 5 of the fixed lock element 1. The engagement of lugs 5 and finger lugs 12 will prevent the rotatable lock element 9 from being released from the fixed lock element 1, whose spring element 18 will maintain the fixed and rotatable lock elements 1, 9 in the locked position depicted in FIG. 3.

To unlock the locking mechanism, the fixed lock element 1 is pushed into the cylindrical chamber 7. As the fixed lock element 1 is pushed into the cylindrical chamber 7 (against the biasing force of spring element 18), the spring element 18' of the rotatable lock element 9 pulls the rotatable lock element 9 until resilient lugs 14 contact or abut cut-out stepped portions 20'. In this position, the base 10 of the rotatable lock element 9 extends beyond the surrounding surface 25 of the case or container, so that the base 10 can again be grasped by its peripheral edge. The base 10 of the rotatable lock element 9 can thus be rotated (and slightly pushed inward if desired) so that the finger lugs 12 are aligned with the spaces 26 between lugs 5. Once the finger elements 12 are aligned in this unlocked position, the rotatable lock element 9 becomes disengaged with the fixed lock element 1, and the locking mechanism is unlocked.

As can be understood from the above description of the operation of the lock mechanism of the present invention, the force of spring element 18 has to be overcome in order to unlock the lock mechanism. Thus, it is possible to select a spring element 18 which has a strong enough biasing force to prevent infants or young children from unlocking the lock mechanism. This feature of the present invention makes the lock mechanism particularly suitable for securing items such as firearms, medicines, chemicals, etc., from infants and small children.

The elements of the lock mechanism of the present invention can be made of plastic materials, metals, or any suitable materials which will become apparent from the description contained herein.

Figure 6:
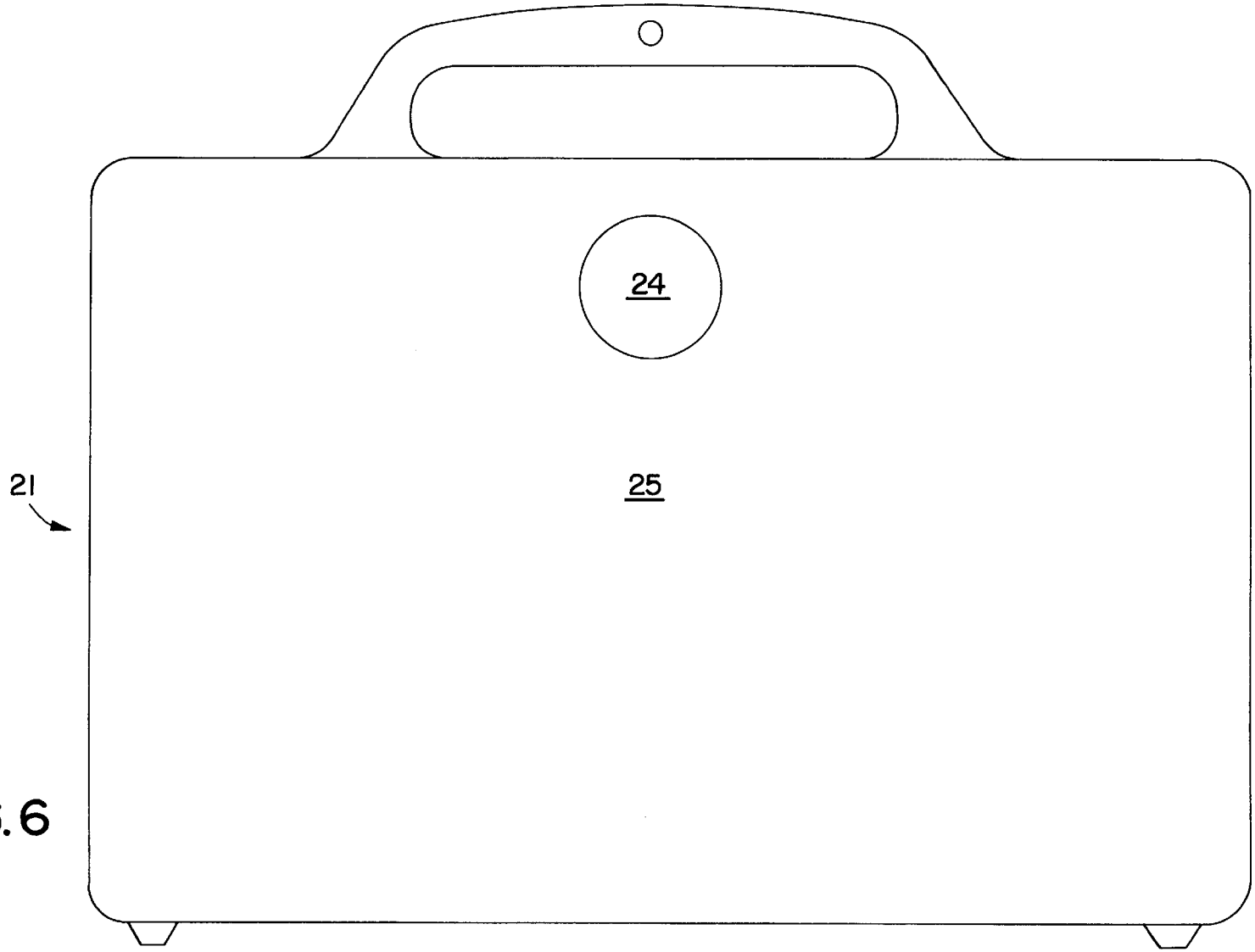
FIG. 6 is a side view of a case which has the lock mechanism of the present invention installed therein.

FIG. 6 is a side view of a case which has the lock mechanism of the present invention installed therein. As can be seen in FIG. 6, only the base (2, 10) of one of the locking elements is visible on the sides 25 of the case 21. Thus, it can be understood how the lock mechanism of the present invention can be essentially concealed by matching the surface appearance, i.e., color, texture, etc., of the outer surfaces (24, 24') of bases (2, 10) of the lock elements (1, 9) with the outer surfaces 25 of the case 21. Otherwise, or additionally, the shape of the bases (2, 10) of the lock elements (1, 9) can be concealed or camouflaged within a pattern or design that extends on the outer surfaces 25 of the case 21.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A lock mechanism which, when installed, includes exposed opposite ends and an axis, the lock mechanism comprising:

a first lock element which is movable along the axis and includes an exposed end for pushing the first lock element in a first direction along the axis and at least one lug opposed from the exposed end;

a spring element which biases the first lock element in a second direction along the axis which is opposite to the first direction;

a second lock element which is rotatable and movable along the axis and includes an exposed end for pushing the second lock element in the second direction along the axis and at least one lug opposed from the exposed end which is engagable with the at least one lug of the first lock element; and a spring element which biases the second lock element in the first direction along the axis.

2. A lock mechanism according to claim 1, wherein the spring elements which bias the first and second lock elements have different spring constants.

3. A lock mechanism according to claim 1, wherein the second lock element can be rotated between:

a first position in which the at least one lug of the second lock element can engage with the at least one lug of the first lock element; and a second position in which the at least one lug of the second lock element cannot be engaged with the at least one lug of the first lock element.

4. A lock mechanism according to claim 1, wherein each of the first and second lock elements comprise base portions and cylindrical body portions from which the lugs extend.

5. A lock mechanism according to claim 1, wherein each of the at least one lugs of one of the first and second lock elements are resilient.

6. A lock mechanism according to claim 4, wherein each of the first and second lock elements include at least one resilient lug which extends from the base thereof.

7. A lock mechanism having an axis and provided in a case having opposed walls which comprises:

a first lock element provided in a first one of the opposed walls of the case which includes an exposed end for pushing the first lock element into the case and at least one lug opposed from the exposed end, the first lock element being movable along the axis;

a spring element which biases the first lock element towards the first wall;

a second lock element provided in a second one of the opposed walls of the case which includes an exposed end for pushing the second lock element into the case and at least one lug opposed from the exposed end, the second lock element being engageable with the at least one lug of the first lock element and rotatable and movable along the axis; and a spring element which biases the second lock element towards the second wall.

8. A lock mechanism according to claim 7, wherein the first and second lock elements include bases and the exposed surfaces comprise outer surfaces on the bases which are flush with outer surfaces of the opposed walls of the case when the lock mechanism is in a locked position.

9. A lock mechanism according to claim 8, wherein the outer surfaces of the bases of the first and second lock elements and the outer surfaces of the opposed walls of the case are substantially similar visually.

10. A lock mechanism according to claim 7, wherein the spring which biases the first lock element has a larger spring constant than the spring element that biases the second lock element.

11. A lock mechanism according to claim 7, further including a chamber which extends between the opposed walls of the case, in which chamber the first and second lock elements are positioned.

12. A lock mechanism according to claim 11, wherein the chamber comprises two half chamber portions which are axially aligned and provided in separate halves of the case.

13. A lock mechanism according to claim 8, wherein the bases have a circular shape.

14. A lock mechanism according to claim 7, wherein the second lock element can be rotated between:

a first position in which the at least one lug of the second lock element can engage with the at least one lug of the first lock element; and a second position in which the at least one lug of the second lock element cannot be engaged with the at least one lug of the first lock element.

15. A lock mechanism according to claim 7, wherein each of the first and second lock elements comprise base portions and cylindrical body portions from which the lugs extend.

16. A lock mechanism according to claim 7, wherein each of the at least one lugs of one of the first and second lock elements are resilient.

17. A lock mechanism according to claim 8, wherein each of the first and second lock elements include at least one resilient lug which extends from the base thereof which at least one resilient lug holds the corresponding lock elements in the case.

18. A lock mechanism according to claim 17, further including:

a chamber which extends between the opposed walls of the case, in which chamber the first and second lock elements are positioned; and cut-out portions in the chamber which are engagable by the at least one resilient lug of the first and second lock elements.

19. A lock mechanism according to claim 18, wherein the cut-out portions which receive the at least one resilient lug of the second lock element have widths which are greater than the width of the at least one resilient lug.

20. A lock mechanism according to claim 7, wherein the case is a gun case.

* * * * *